US007996985B2

(12) United States Patent
Kuo

(10) Patent No.: US 7,996,985 B2
(45) Date of Patent: Aug. 16, 2011

(54) METHOD OF MAKING A RELAY

(75) Inventor: Ming-Chang Kuo, Changhua (TW)

(73) Assignee: Excel Cell Electronic Co., Ltd, Taichung (TW)

( * ) Notice: Subject to any disclaimer, the term of this patent is extended or adjusted under 35 U.S.C. 154(b) by 808 days.

(21) Appl. No.: 11/938,981

(22) Filed: Nov. 13, 2007

(65) Prior Publication Data

US 2009/0119906 A1 May 14, 2009

(51) Int. Cl.
*H01F 7/127* (2006.01)
*H01R 43/20* (2006.01)

(52) U.S. Cl. ..... 29/602.1; 29/606; 29/857; 29/861; 29/844; 335/133; 335/202

(58) Field of Classification Search ..... 29/602.1, 29/604, 606, 861, 857, 842, 844, 622; 335/132, 335/133, 202
See application file for complete search history.

(56) References Cited

U.S. PATENT DOCUMENTS

| | | | | |
|---|---|---|---|---|
| 4,686,500 | A | 8/1987 | Ide et al. | |
| 5,041,870 | A | 8/1991 | Imai et al. | |
| 5,894,253 | A | 4/1999 | Ichikawa et al. | |
| 2006/0181380 | A1 * | 8/2006 | Nakamura et al. | 335/132 |

FOREIGN PATENT DOCUMENTS

| | | | |
|---|---|---|---|
| JP | 05307927 | A * | 11/1993 |
| JP | 2006-210289 | A | 8/2006 |

* cited by examiner

*Primary Examiner* — A. Dexter Tugbang
(74) *Attorney, Agent, or Firm* — Fox Rothschild, LLP; Robert J. Sacco

(57) ABSTRACT

A method of making a relay includes: preparing a relay core member; coupling first, second and third terminals to the relay core member by moving the same horizontally relative to the relay core member such that terminal portions of the first, second and third terminals enter notches formed in the relay core member in a horizontal direction; and enclosing the relay core member, the first terminal, the second terminal, and the third terminal within a housing, and sealing the housing with resin.

1 Claim, 20 Drawing Sheets

METHOD OF MAKING A RELAY

BACKGROUND OF THE INVENTION

1. Field of the Invention

The invention relates to a method of making a relay.

2. Description of the Related Art

As shown in FIG. 1, a conventional method of making a relay 10 (see FIG. 9) comprises steps 21 to 26.

As shown in FIGS. 1 and 2, the step 21 is to prepare a relay core member 11 including a base plate 111 that extends in a horizontal direction (X) and that is formed with a through hole 116, a top plate 112 that extends in the horizontal direction (X) and that is spaced apart from the base plate 111 in a vertical direction (Y), a coil unit 110 that extends in the vertical direction (Y) and that is disposed between the base and top plates 111, 112, and a connecting plate 114 that interconnects the base and top plates 111, 112 and that is disposed between the coil unit 110 and the through hole 116. The coil unit 110 includes a core 113, a coil 12 wound on the core 113, and a pair of rods 115, each of which is coupled to the coil 12 and extends through the base plate 111.

As shown in FIGS. 1, 3, and 4, the step 22 is to prepare a first terminal 13 that has a first terminal portion 131 formed with a plate engaging notch 1310, a first fixed portion 132 extending perpendicularly from one edge of the first terminal portion 131, and a first contact 133 disposed on the first fixed portion 131, and to couple the first terminal 13 to the relay core member 11 by moving the first terminal 13 horizontally relative to the relay core member 11 such that the plate engaging notch 1310 engages the base plate 111 of the relay core member 11, that a portion of the first terminal portion 131 extends downwardly relative to the base plate 111, and that the first fixed portion 132 extends horizontally above the top plate 112 of the relay core member 11.

As shown in FIGS. 1, 5, and 6, the step 23 is to prepare a second terminal 14 that has a second terminal portion 141, a resilient portion 142 extending perpendicularly from one edge of the second terminal portion 141, a second contact 143 disposed on the resilient portion 142, a pair of opposite wing portions 144 formed at two sides of the second terminal portion 141, and a pair of tongue pieces 145 formed respectively at the wing portions 144, and to couple the second terminal 14 to the relay core member 11 by moving the second terminal 14 vertically relative to the relay core member 11 such that the second terminal portion 141 extends downwardly through the through hole 116 in the base plate 111, that the resilient portion 142 extends horizontally above the top plate 112 and the first fixed portion 132 of the first terminal 13, and that the second contact 143 is registered with the first contact 133 of the first terminal 13. After the second terminal 14 is coupled to the relay core member 11, an operator has to fold each of the wing portions 144 manually toward the connecting plate 114 with the use of a tool (not shown) such that the tongue pieces 145 engage respectively opposite sides of the connecting plate 144, thereby positioning the second terminal 14 relative to the relay core member 11.

As shown in FIGS. 1, 7, and 8, the step 24 is to prepare a third terminal 15 that has a third terminal portion 151 formed with plate engaging notches 1510, 1511, a second fixed portion 152 extending perpendicularly from one edge of the third terminal portion 151, and a third contact 153 disposed on the second fixed portion 152, and to couple the third terminal 15 to the relay core member 11 by moving the third terminal 15 horizontally relative to the relay core member 11 such that the plate engaging notches 1510, 1511 respectively engage the top and base plates 112, 111 of the relay core member 11, that a portion of the third terminal portion 151 extends downwardly relative to the base plate 111, that the second fixed portion 152 extends horizontally above the resilient portion 142 of the second terminal 14, and that the third contact 153 is registered with the second contact 142.

The step 25 is to test the resiliency of the resilient portion 142 of the second terminal 14 via a testing instrument (not shown). If the testing result does not fall within the standard range, the operator has to adjust manually the resilient portion 142 with the use of a tool so as to meet the standard requirement.

As shown in FIGS. 1 and 9, the step 26 is to enclose the relay core member 11, the first terminal 13, the second terminal 14, and the third terminal 15 within a housing 16, and to seal the housing 16 with resin 17 filled between the housing 16 and the base plate 111 of the relay core member 11.

In use, the second contact 143 of the second terminal 14 contacts the third contact 153 of the third terminal 15 to form a first circuit when current does not flow through the coil unit 110. When current flows through the coil unit 110, an electromagnetic field is generated to attract the resilient portion 142 of the second terminal 14 such that the second contact 143 is separated from the third contact 153 and contacts the first contact 133 of the first terminal 13, thereby forming a second circuit.

However, since the second terminal 14 is vertically coupled to the relay core member 11, and since the tongue pieces 145 will affect vertical movement of the second terminal 14 if the wing portions 144 are folded prior to coupling the second terminal 14 to the relay core member 11, the second terminal 14 has to be assembled manually. Moreover, since the resiliency of the resilient portion 142 of the second terminal 14 may deviate from the standard range during manual assembly of the second terminal 14, the step 25 of testing the resiliency of the resilient portion 142 of the second terminal 14 after coupling to the relay core member 11 is required. Therefore, the conventional assembling method results in a relatively high cost of manufacture. Furthermore, if the tolerance range of the through hole 116 in the base plate 111 of the relay core member 11 is too large, the second terminal portion 141 of the second terminal 14 may not be properly assembled relative to the relay core member 11 since the second terminal portion 141 extends loosely through the through hole 116, such that the operator has to spend more time to assemble properly the second terminal 14, thereby resulting in higher manufacturing costs.

SUMMARY OF THE INVENTION

Therefore, the object of the present invention is to provide a method of making a relay with a higher efficiency and a lower cost of manufacturing.

Accordingly, a method of making a relay of the present invention comprises the steps of: (A) preparing a relay core member that includes a base plate extending in a horizontal direction and formed with first, second, and third notches, a top plate extending in the horizontal direction and spaced apart from the base plate in a vertical direction, a coil unit extending in the vertical direction and disposed between the base and the top plates, and a connecting plate interconnecting the base and top plates and disposed between the second notch in the base plate and the coil unit; (B) preparing a first terminal that has a first terminal portion, a first fixed portion extending perpendicularly from one edge of the first terminal portion, and a first contact disposed on the first fixed portion, and coupling the first terminal to the relay core member by moving the first terminal horizontally relative to the relay core member such that the first terminal portion enters the first notch in the horizontal direction and extends downwardly through the base plate, and that the first fixed portion extends horizontally above the top plate of the relay core member; (C) preparing a second terminal that has a second terminal portion, a resilient portion extending perpendicularly from one edge of the second terminal portion, a second contact disposed on the resilient portion, a pair of opposite wing portions formed at two sides of the second terminal portion, and a pair of tongue pieces formed respectively at the wing portions, and coupling the second terminal to the relay core member by moving the second terminal horizontally relative to the relay core member such that the second terminal portion enters the second notch in the horizontal direction and extends downwardly through the base plate, that the resilient portion extends horizontally above the first fixed portion of the first terminal, that the second contact is registered with the first contact, and that the tongue pieces engage the connecting plate; (D) preparing a third terminal that has a third terminal portion, a second fixed portion extending perpendicularly from one edge of the third terminal portion, and a third contact disposed on the second fixed portion, and coupling the third terminal to the relay core member by moving the third terminal horizontally relative to the relay core member such that the third terminal portion enters the third notch in the horizontal direction and extends downwardly through the base plate, that the second fixed portion extends horizontally above the resilient portion of the second terminal and is supported thereat by the top plate of the relay core member, and that the third contact is registered with the second contact; and (E) enclosing the relay core member, the first terminal, the second terminal, and the third terminal within a housing, and sealing the housing with resin filled between the housing and the base plate of the relay core member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Before the present invention is described in greater detail, it should be noted that the relative positional terminology used in the following description, e.g., "horizontal direction (X)" and "vertical direction (Y)", are based on the directions illustrated in the accompanying drawings, and that the horizontal direction (X) is perpendicular to the vertical direction (Y).

Figure 1:
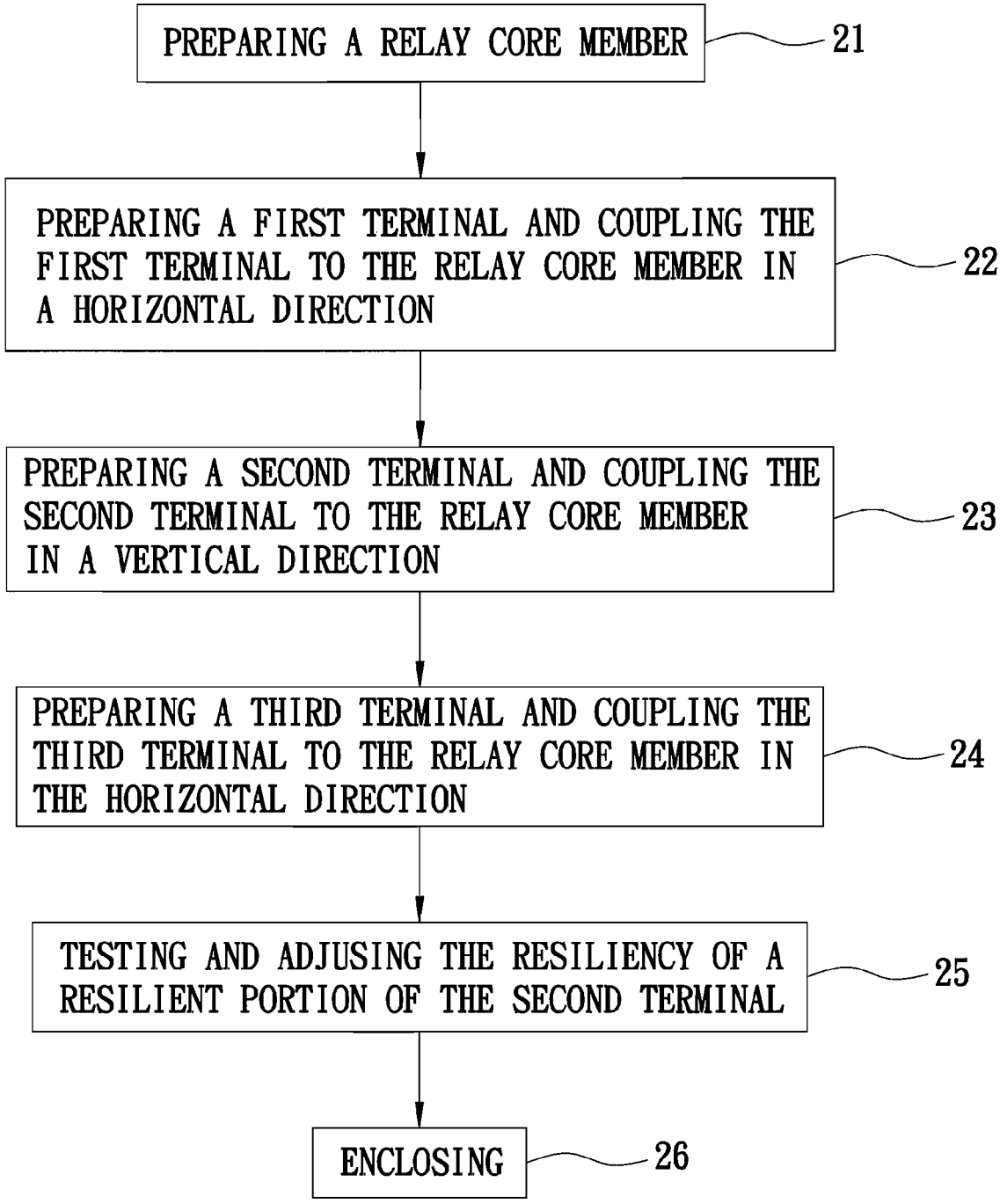
FIG. 1 PRIOR ART
FIG. 1 is a flow chart of a conventional method of making a relay.
Figure 2:
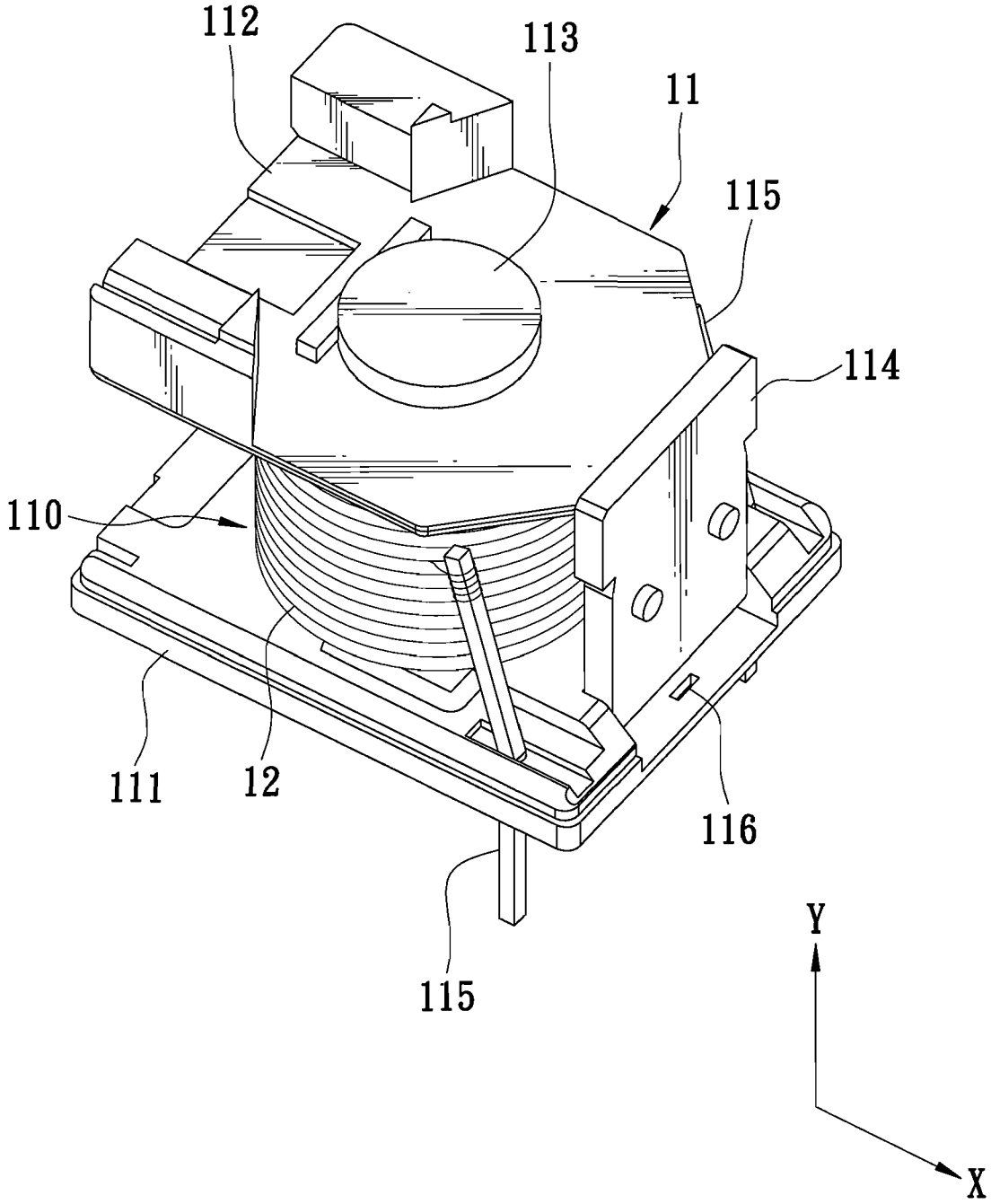
FIG. 2 PRIOR ART
FIG. 2 is a perspective view of a relay core member used in the conventional method.
Figure 3:
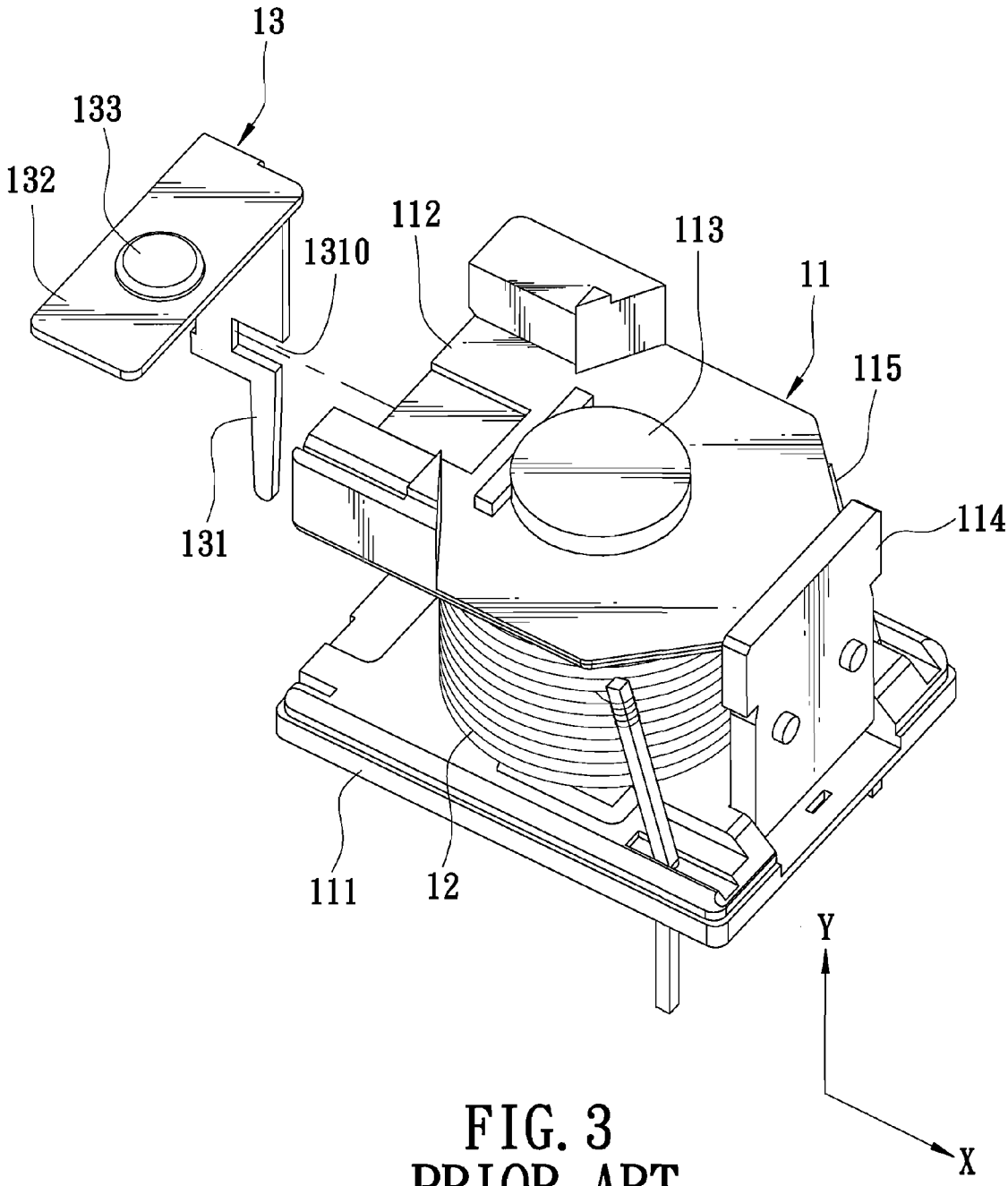
FIG. 3 PRIOR ART
FIG. 3 is a fragmentary exploded perspective view, illustrating a first terminal before being coupled to the relay core member according to the conventional method.
Figure 4:
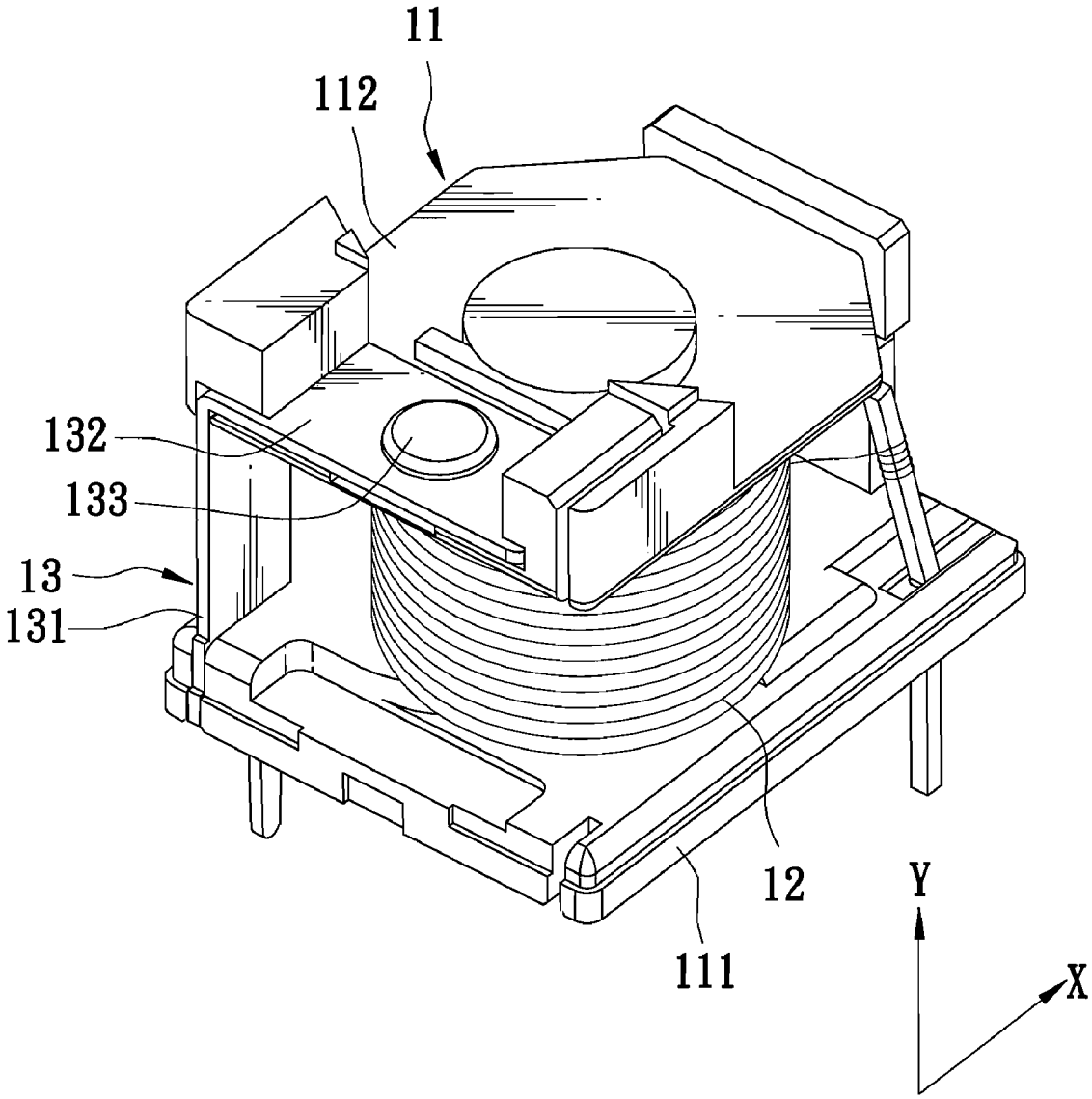
FIG. 4 PRIOR ART
FIG. 4 is a fragmentary assembled perspective view, illustrating the first terminal after being coupled to the relay core member according to the conventional method.
Figure 5:
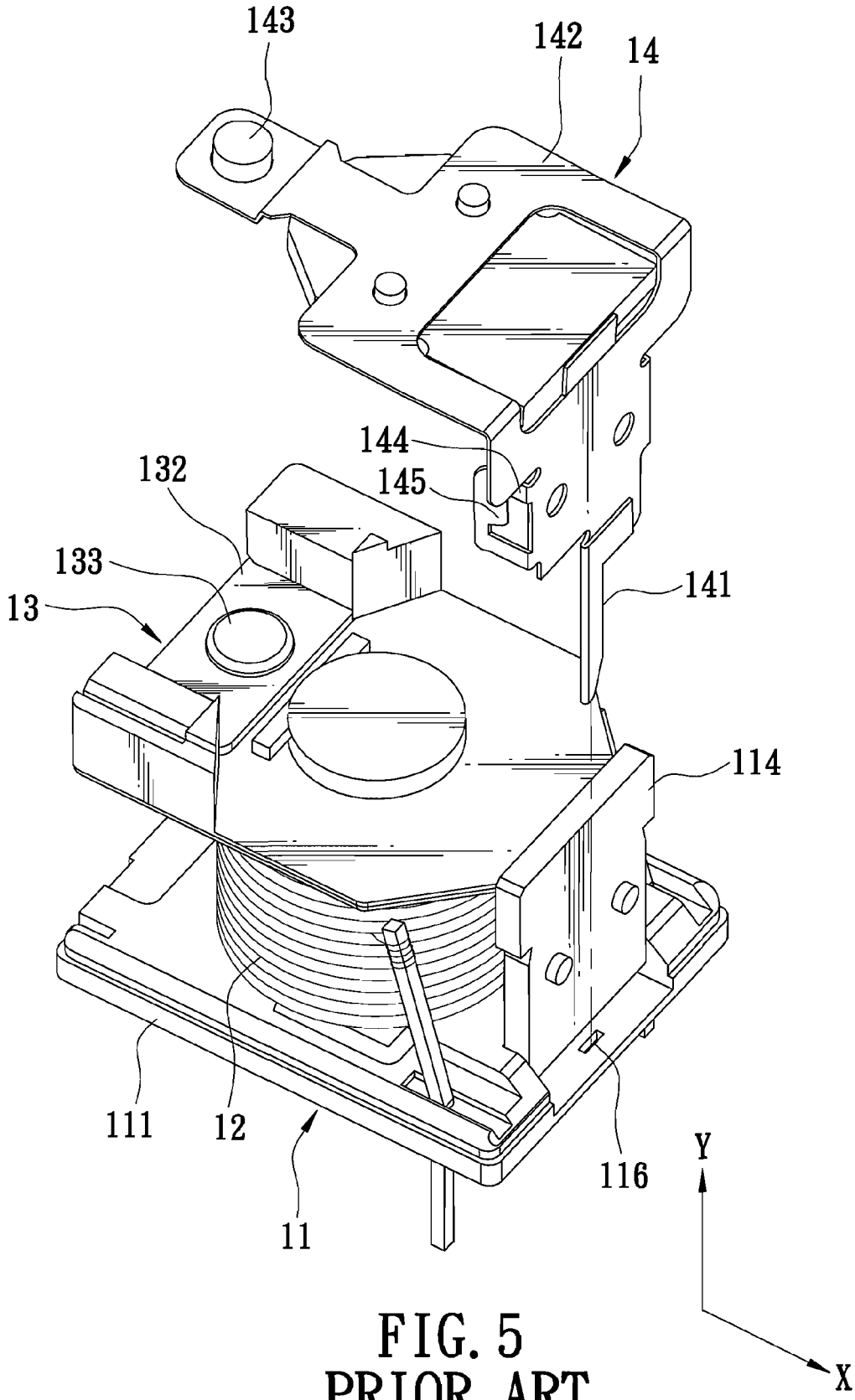
FIG. 5 PRIOR ART
FIG. 5 is a fragmentary exploded perspective view, illustrating a second terminal before being coupled to the relay core member according to the conventional method.
Figure 6:
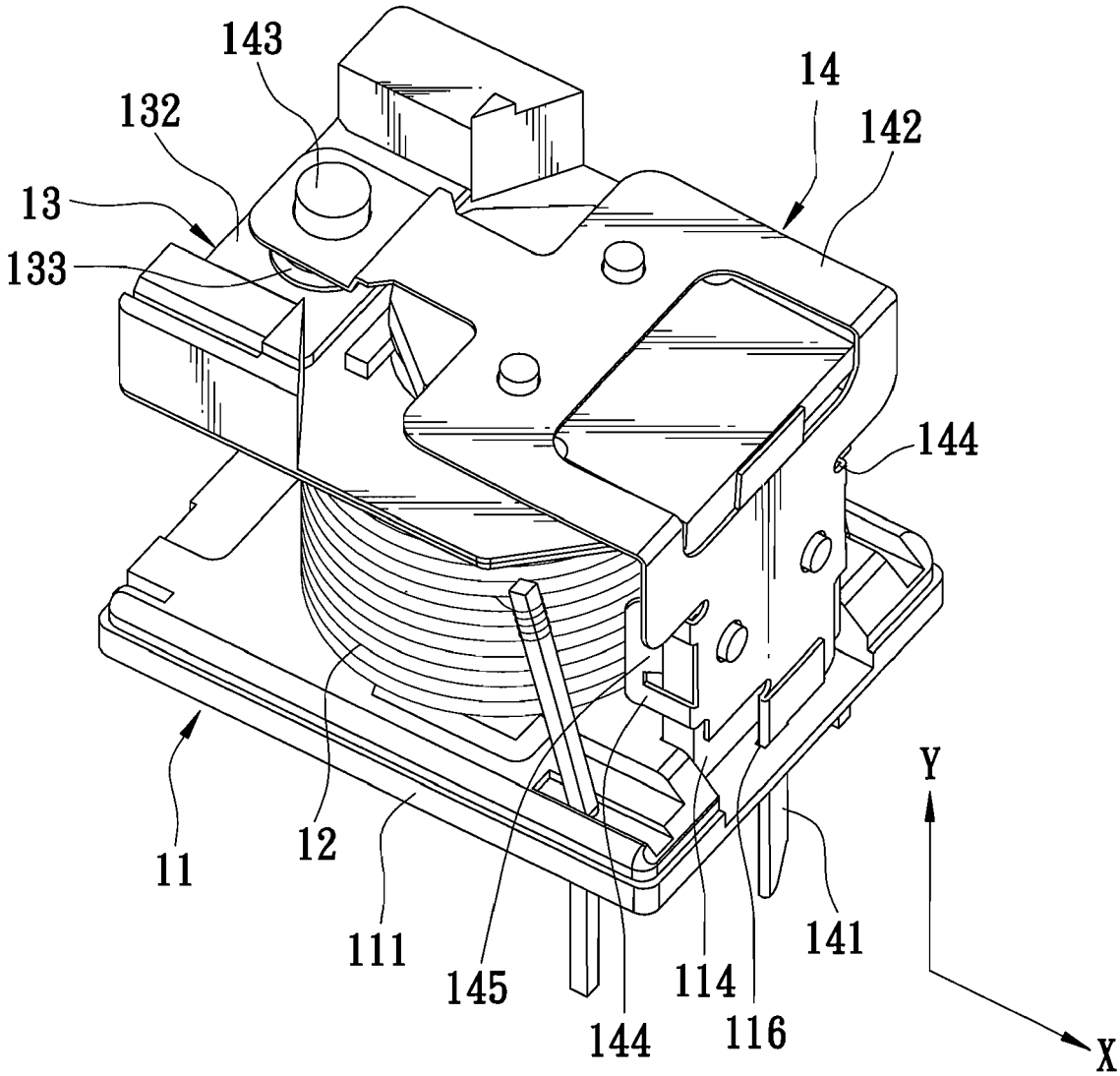
FIG. 6 PRIOR ART
FIG. 6 is a fragmentary assembled perspective view, illustrating the second terminal after being coupled to the relay core member according to the conventional method.
Figure 7:
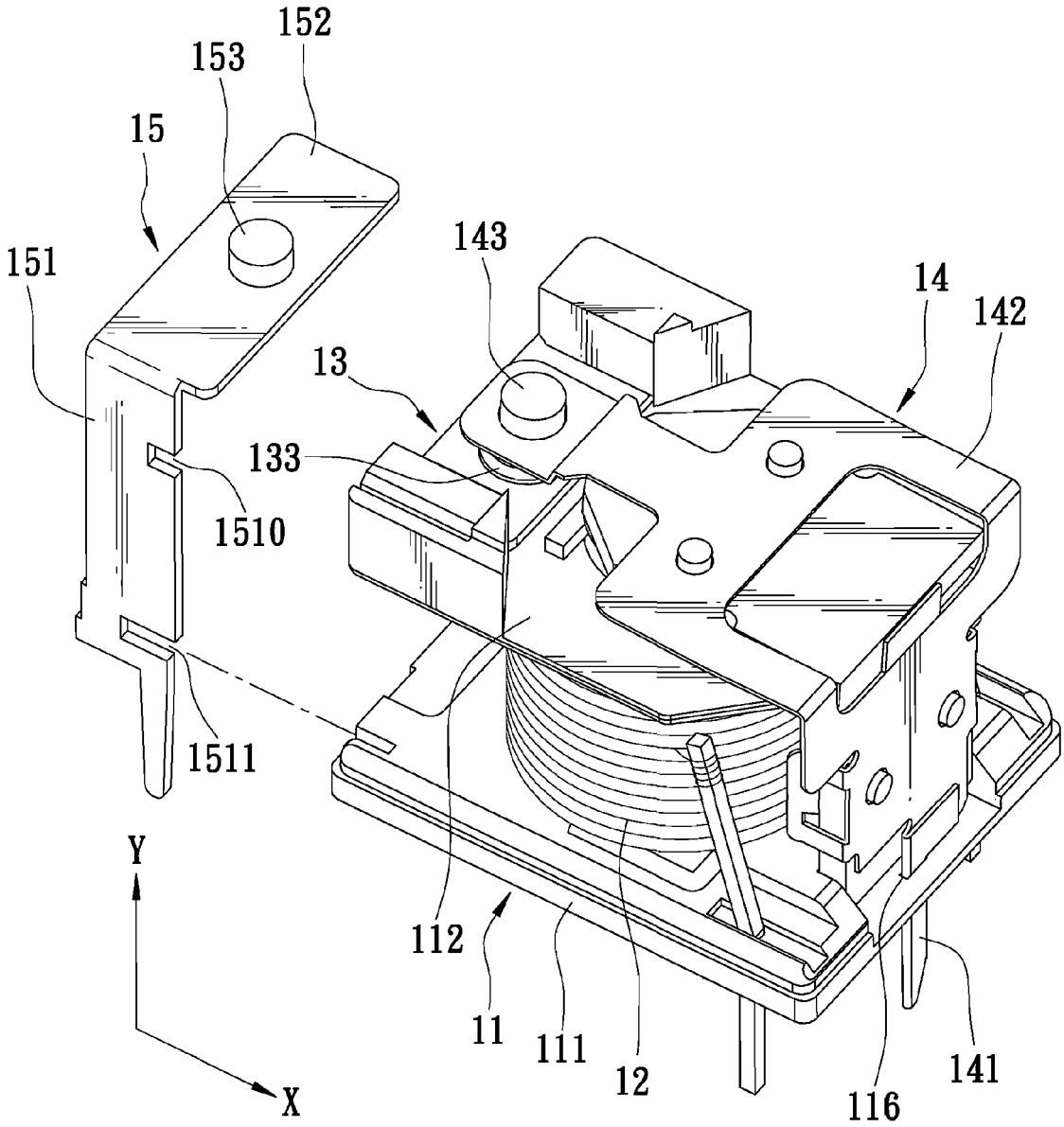
FIG. 7 PRIOR ART
FIG. 7 is a fragmentary exploded perspective view, illustrating a third terminal before being coupled to the relay core member according to the conventional method.
Figure 8:
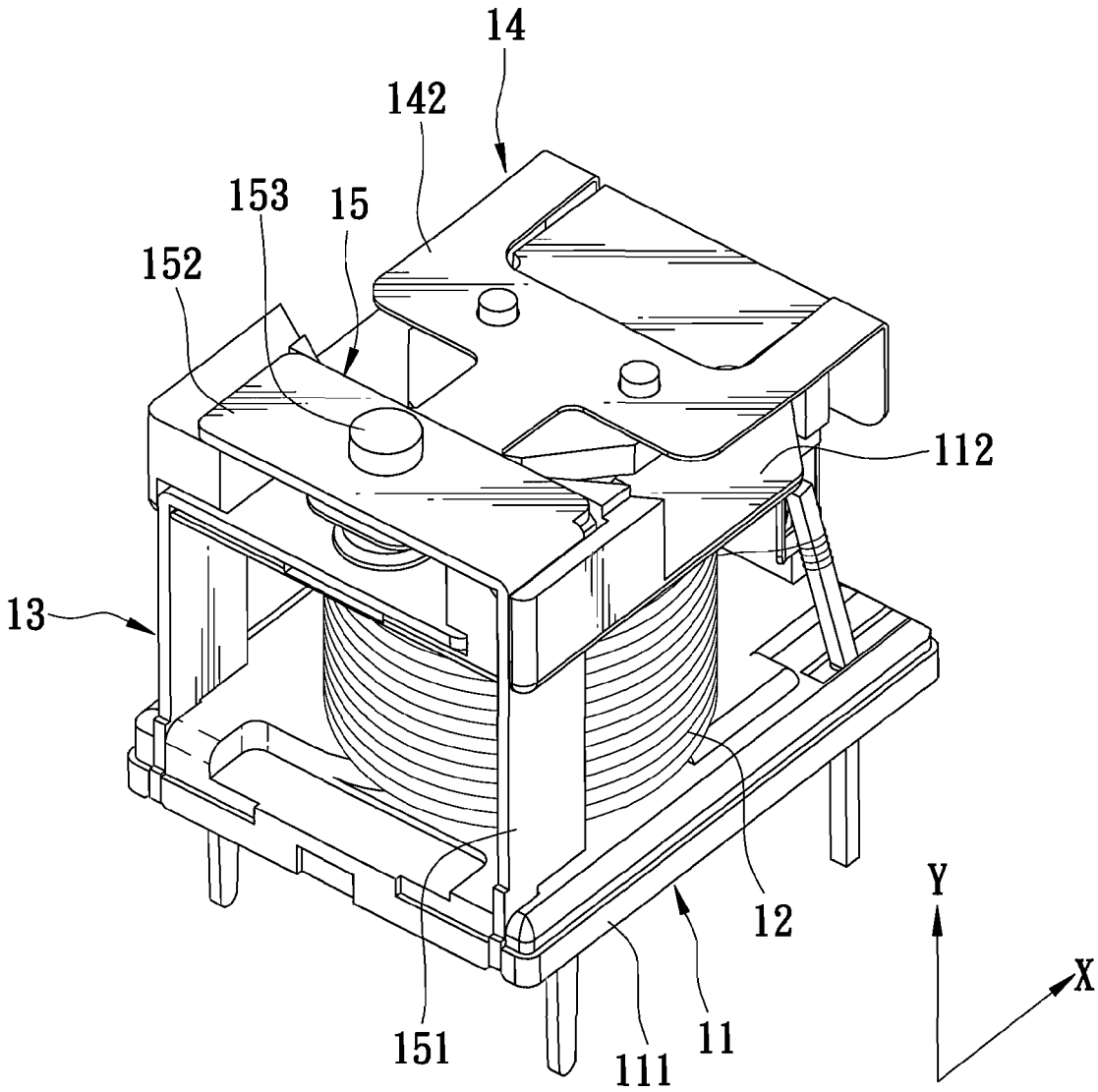
FIG. 8 PRIOR ART
FIG. 8 is a fragmentary assembled perspective view, illustrating the third terminal after being coupled to the relay core member according to the conventional method.
Figure 9:
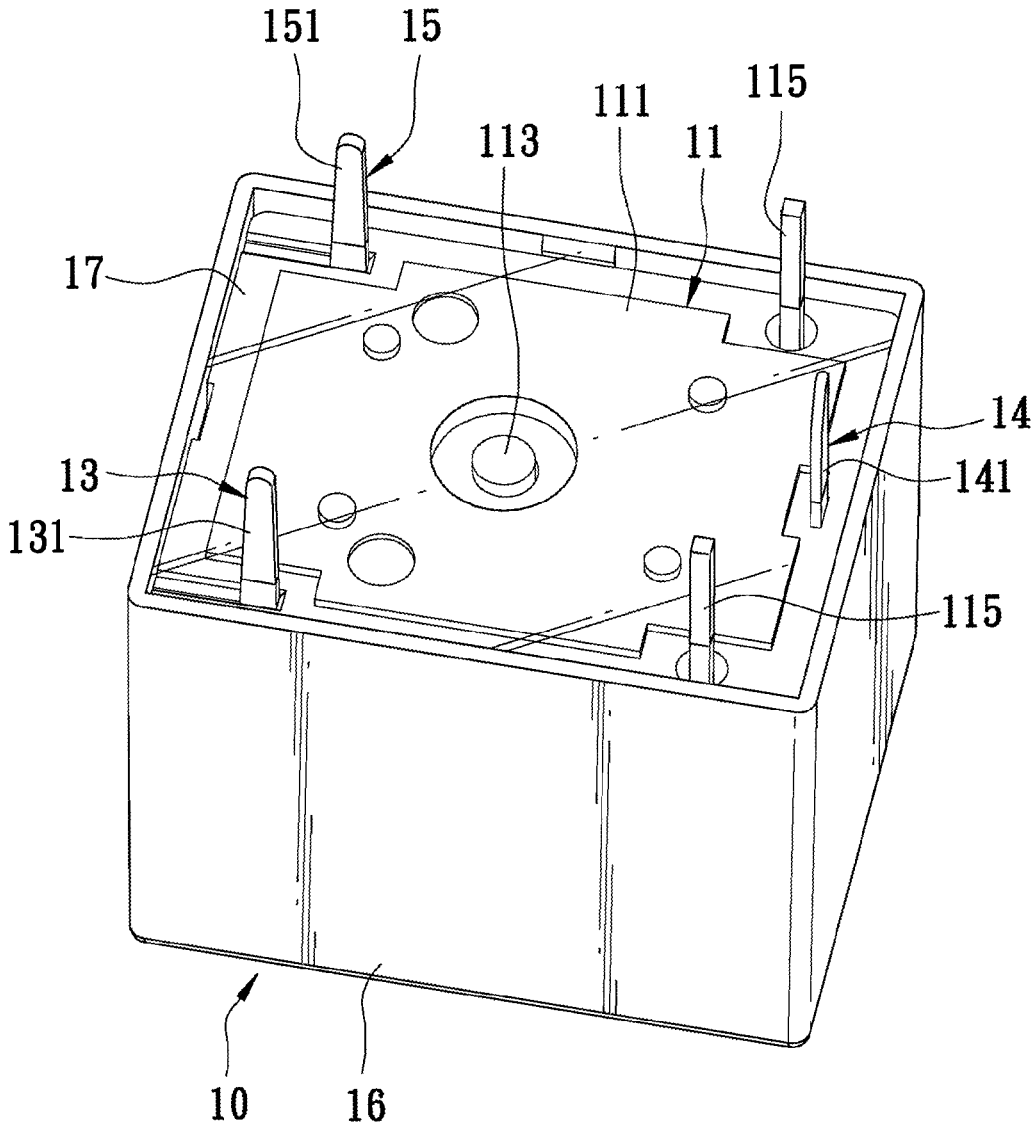
FIG. 9 PRIOR ART
FIG. 9 is an assembled perspective view, illustrating the relay core member enclosed in a housing with sealant filled therebetween according to the conventional method.
Figure 10:
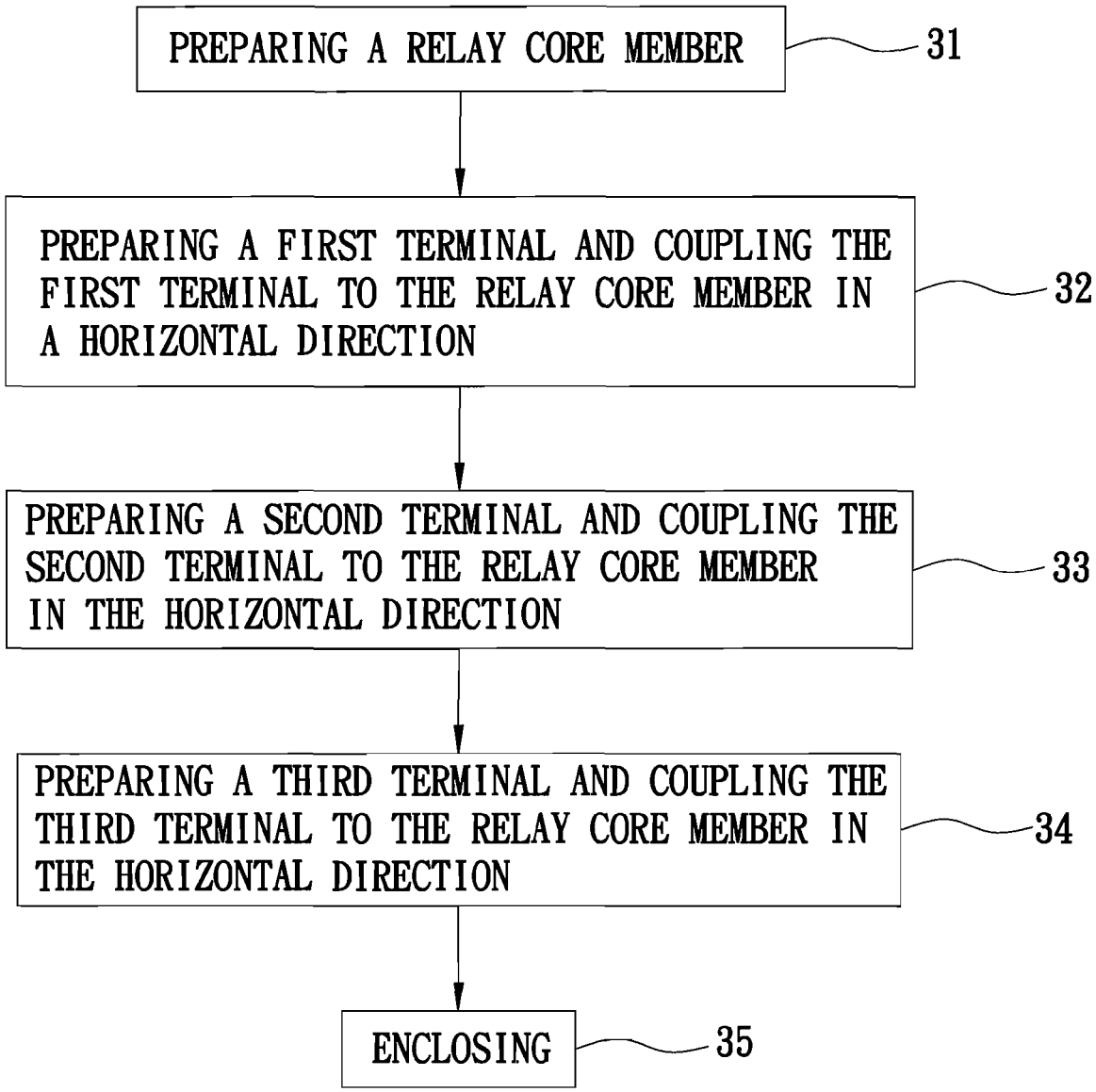
FIG. 10 is a flow chart of a preferred embodiment of a method of making a relay according to the invention.

As shown in FIG. 10, the preferred embodiment of a method of making a relay according to the present invention comprises steps 31 to 35.

Figure 11:
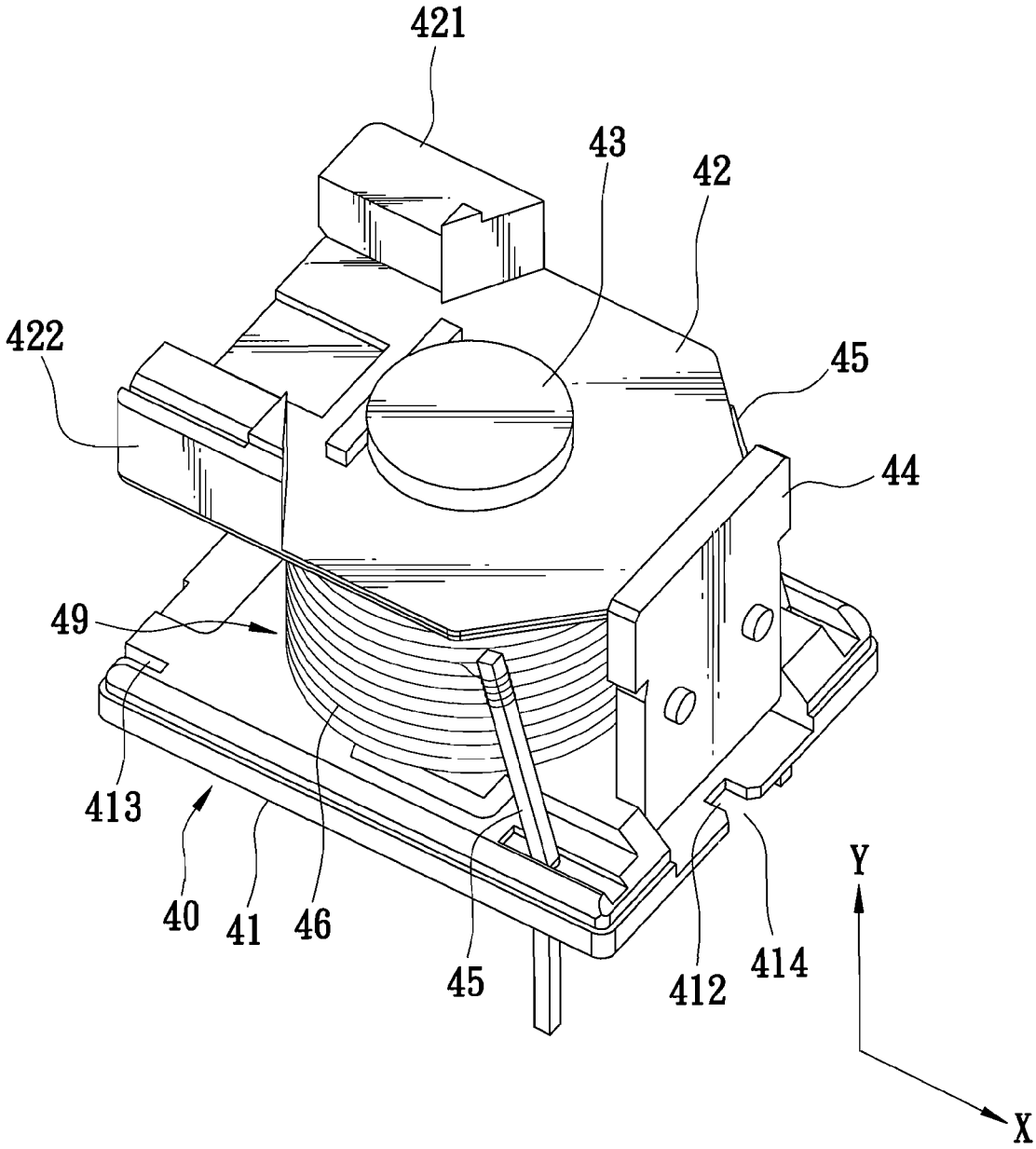
FIG. 11 is a perspective view of a relay core member used in the preferred embodiment.
Figure 12:
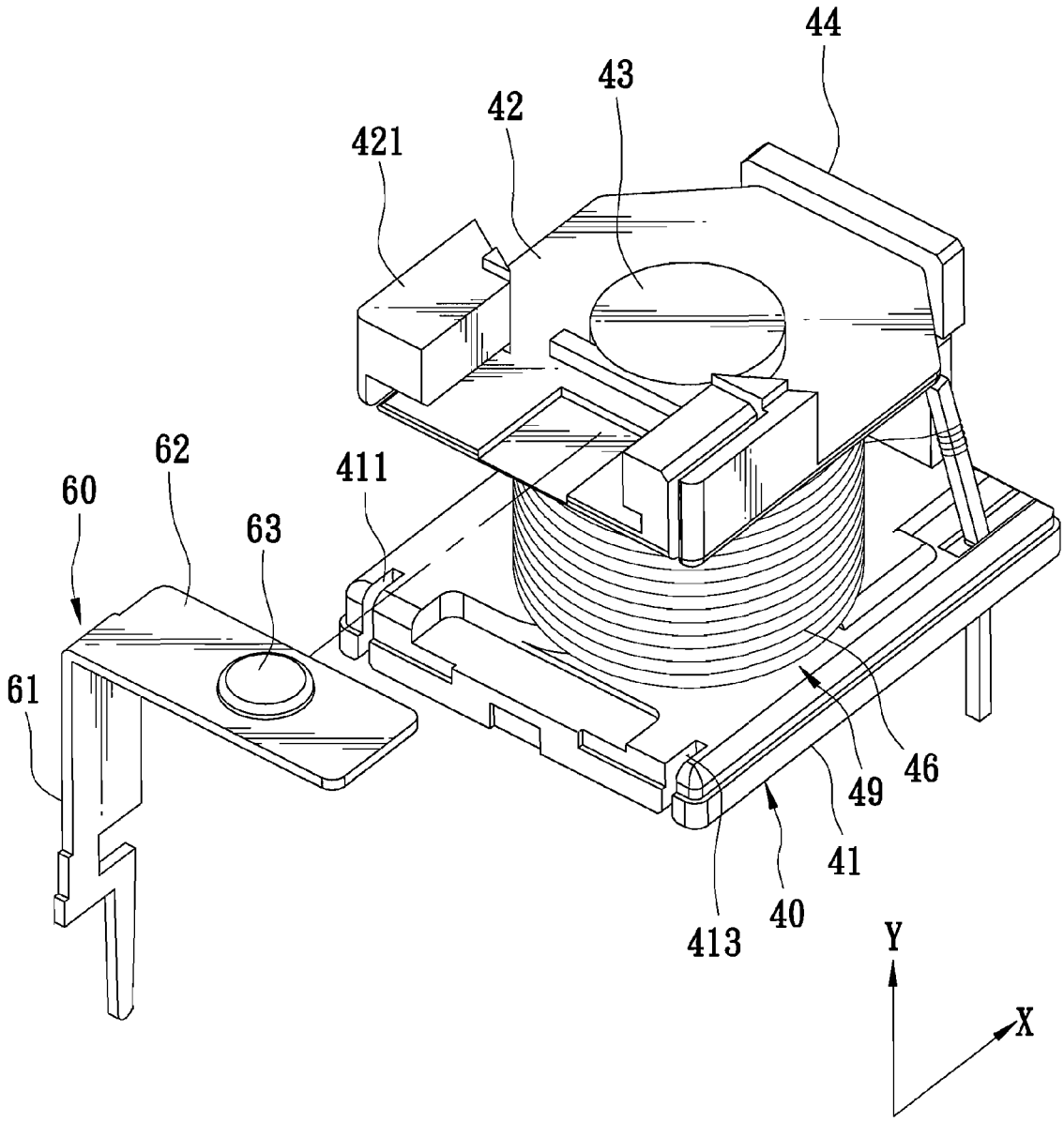
FIG. 12 is a fragmentary exploded perspective view, illustrating a first terminal before being coupled to the relay core member according to the preferred embodiment.

As shown in FIGS. 10 to 12, the step 31 is to prepare a relay core member 40 including a base plate 41 that extends in a horizontal direction (X), a top plate 42 that extends in the horizontal direction (X) and that is spaced apart from the base plate 41 in a vertical direction (Y), a coil unit 49 that extends in the vertical direction (Y) and that is disposed between the base and top plates 41, 42, and a connecting plate 44 that interconnects the base and top plates 41, 42. The coil unit 49 includes a core 43, a coil 46 wound on the core 43, and a pair of rods 45, each of which is coupled to the coil 46 and extends through the base plate 41.

The base plate 41 of the relay core member 40 has one edge formed with a first notch 411 and a third notch 413 that extend in the horizontal direction (X) and that are spaced apart from each other, and has an opposite edge formed with a second notch 412 that extends in the horizontal direction (X). The connecting plate 44 is disposed between the second notch 412 and the coil unit 49. Preferably, the second notch 412 has a flaring opening 414. The top plate 42 is formed with a pair of spaced apart first and second engaging blocks 421, 422 at one edge above the first and third notches 411, 413.

Figure 13:
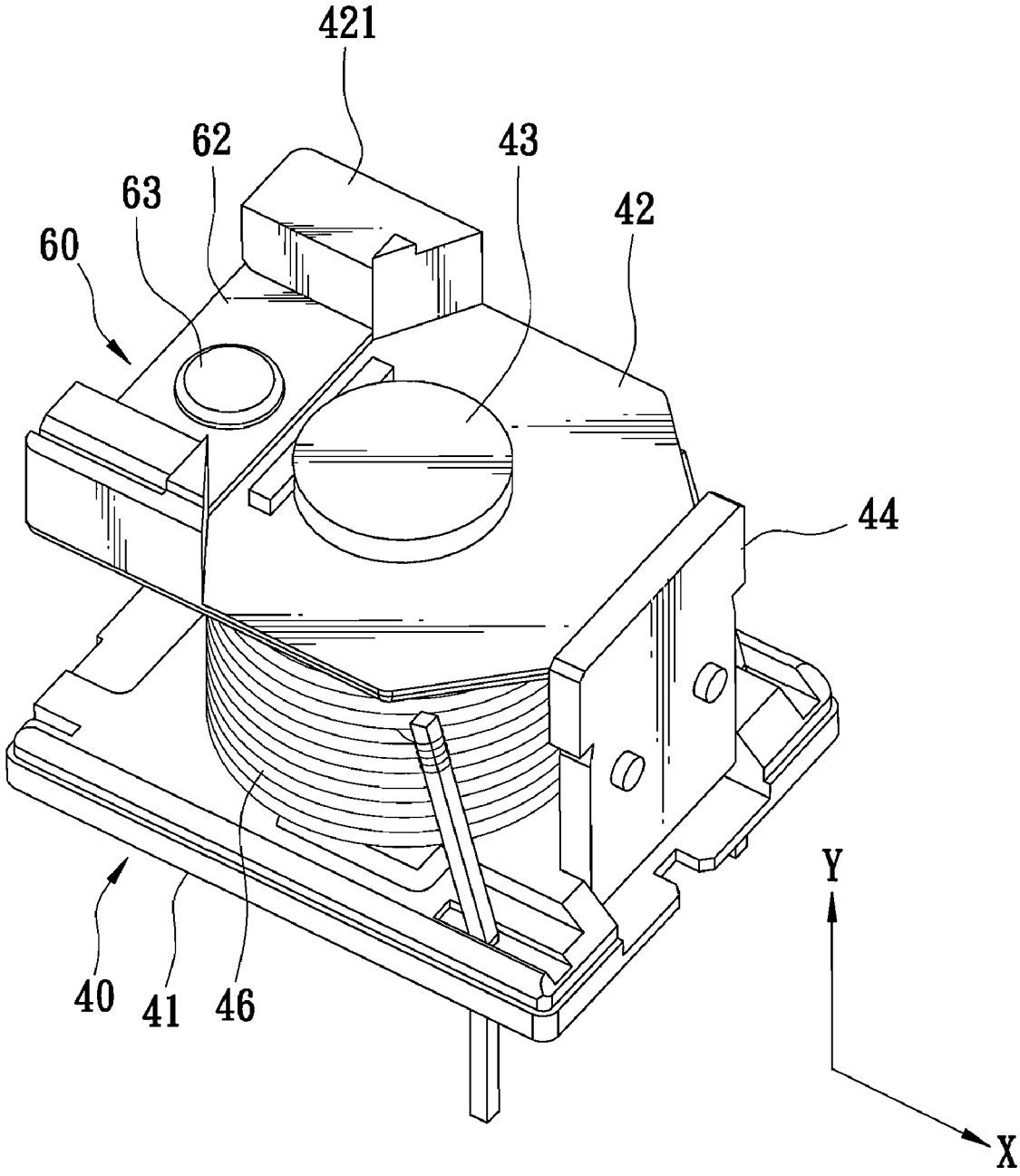
FIG. 13 is a fragmentary assembled perspective view, illustrating the first terminal after being coupled to the relay core member according to the preferred embodiment.

As shown in FIGS. 10, 12, and 13, the step 32 is to prepare a first terminal 60 that has a first terminal portion 61, a first fixed portion 62 extending perpendicularly from one edge of the first terminal portion 61, and a first contact 63 disposed on the first fixed portion 61, and to couple the first terminal 60 to the relay core member 40 by moving the first terminal 60 horizontally relative to the relay core member 40 such that the first terminal portion 61 enters the first notch 411 in the horizontal direction (X) and extends downwardly through the base plate 41, and that the first fixed portion 62 engages the first engaging block 421 on the top plate 42 and extends horizontally above the top plate 42 of the relay core member 40.

Figure 14:
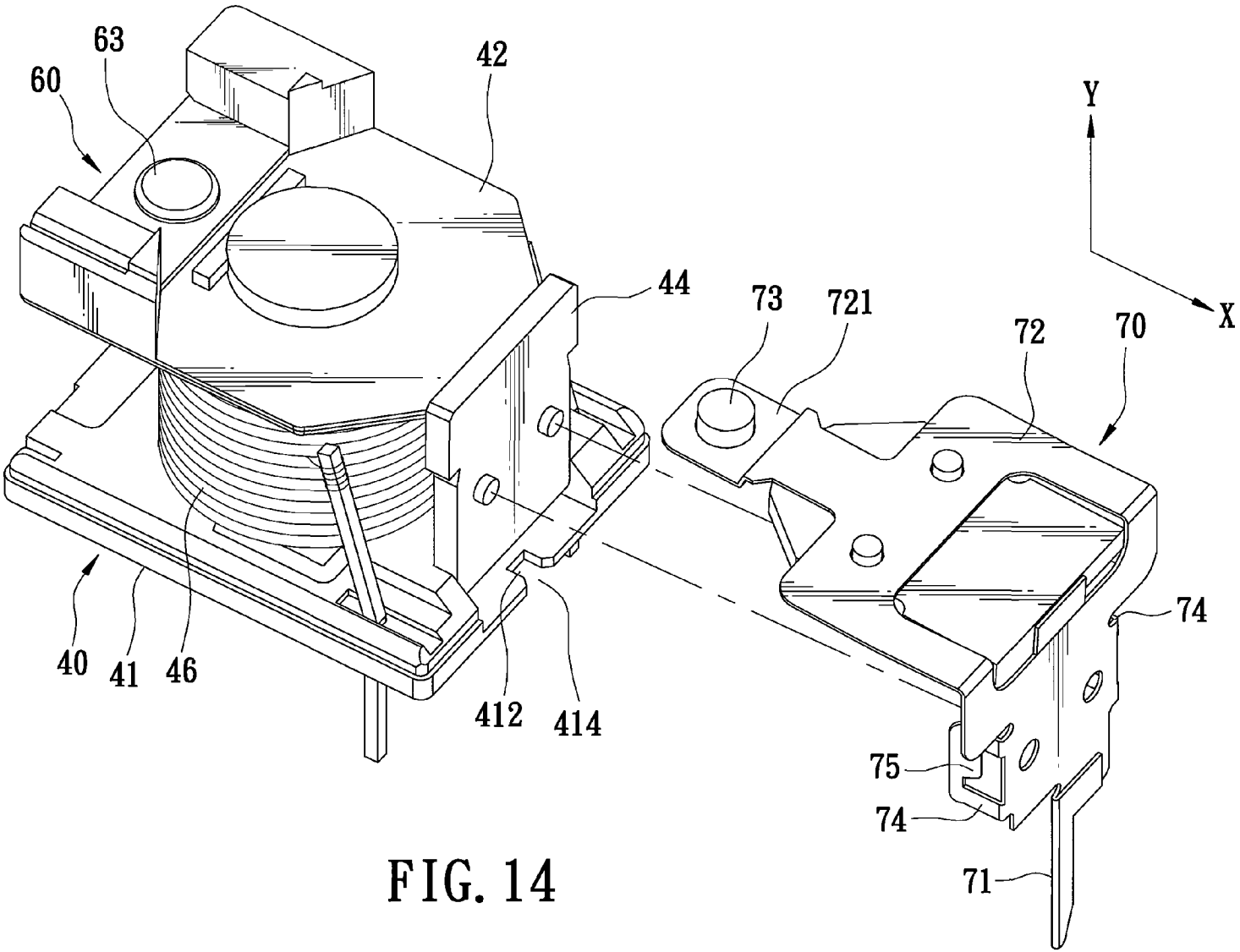
FIG. 14 is a fragmentary exploded perspective view, illustrating a second terminal before being coupled to the relay core member according to the preferred embodiment.
Figure 15:
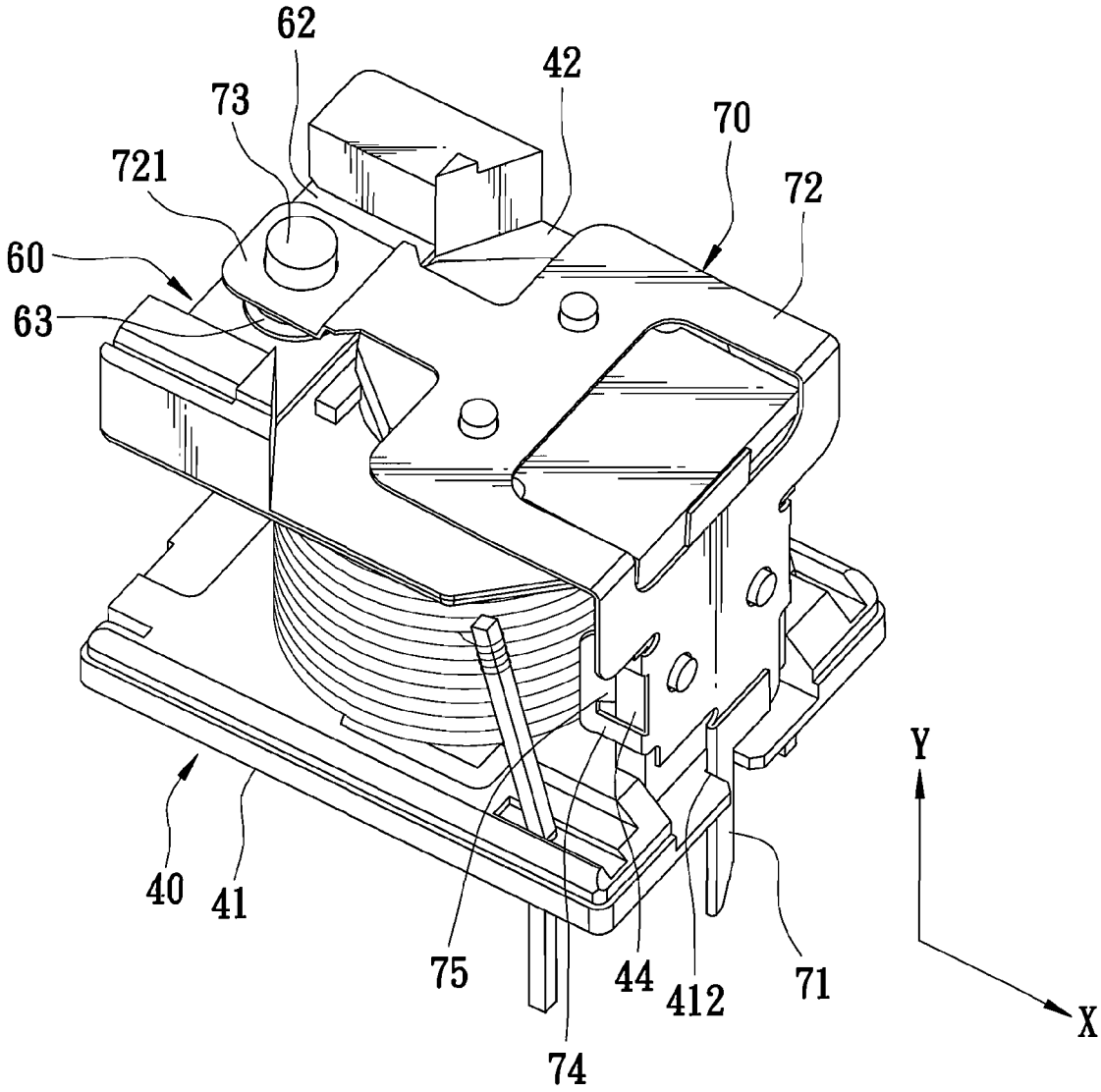
FIG. 15 is a fragmentary assembled perspective view, illustrating the second terminal after being coupled to the relay core member according to the preferred embodiment.

As shown in FIGS. 10, 14, and 15, the step 33 is to prepare a second terminal 70 that has a second terminal portion 71, a resilient portion 72 extending perpendicularly from one edge of the second terminal portion 71, a second contact 73 disposed on a distal end part 721 of the resilient portion 72, a pair of opposite wing portions 74 formed at two sides of the second terminal portion 71, and a pair of tongue pieces 75 formed respectively at the wing portions 74, and to couple the second terminal 70 to the relay core member 41 by moving the second terminal 70 horizontally relative to the relay core member 41 such that the second terminal portion 71 enters the second notch 412 in the horizontal direction (X) and extends downwardly through the base plate 41, that the resilient portion 72 extends horizontally above the top plate 42 and the first fixed portion 62 of the first terminal 60, and that the second contact 73 is registered with the first contact 63 of the first terminal 60. Preferably, the wing portions 74 are folded respectively at an angle relative to the second terminal 70 prior to coupling the second terminal portion 71 to the relay core member 40, such that the tongue pieces 75 of the second terminal 70 engage simultaneously opposite sides of the connecting plate 44 of the relay core member 40 when the second terminal portion 71 is inserted in the second notch 412.

Figure 16:
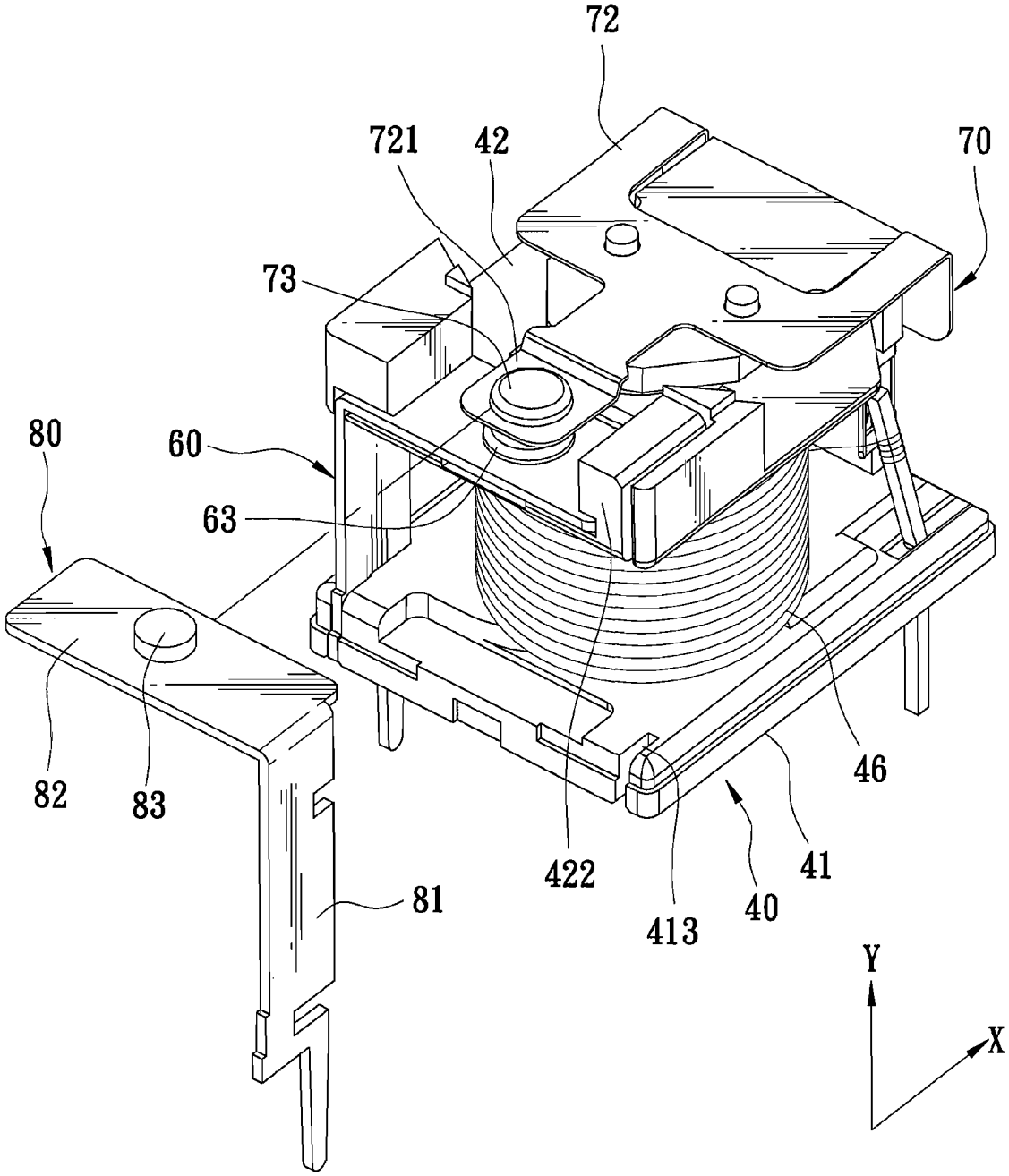
FIG. 16 is a fragmentary exploded perspective view, illustrating a third terminal before being coupled to the relay core member according to the preferred embodiment.
Figure 17:
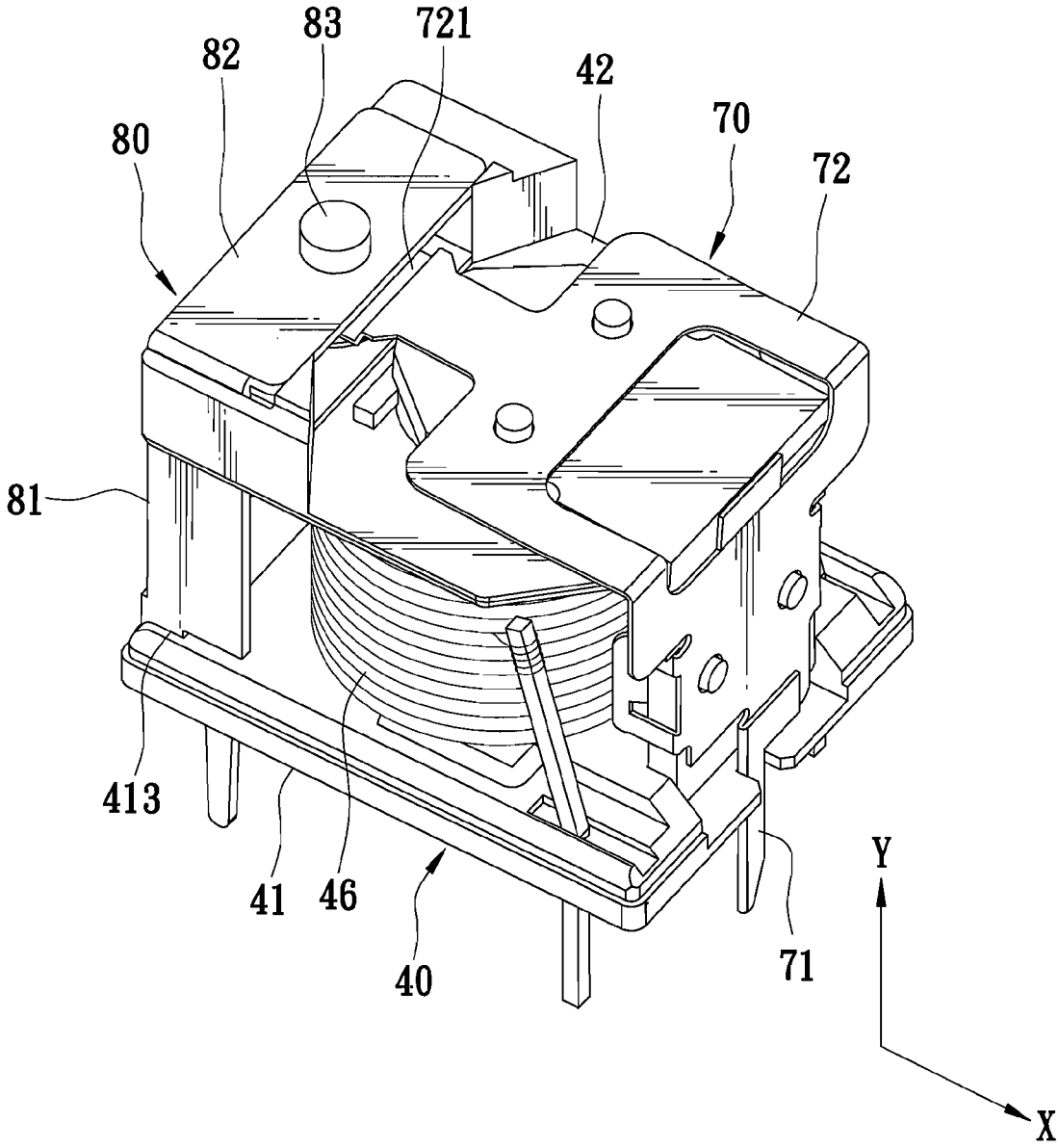
FIG. 17 is a fragmentary assembled perspective view, illustrating the third terminal after being coupled to the relay core member according to the preferred embodiment.

As shown in FIGS. 10, 16, and 17, the step 34 is to prepare a third terminal 80 that has a third terminal portion 81, a second fixed portion 82 extending perpendicularly from one edge of the third terminal portion 81, and a third contact 83 disposed on the second fixed portion 82, and to couple the third terminal 80 to the relay core member 40 by moving the third terminal 80 horizontally relative to the relay core member 40 such that the third terminal portion 81 enters the third notch 413 in the horizontal direction (X), and extends downwardly through the base plate 41, that the second fixed portion 82 extends horizontally above the resilient portion 72 of the second terminal 70 and is supported thereat by the second engaging block 422 on the top plate 42 of the relay core member 40, and that the third contact 83 is registered with the second contact 73.

Figure 18:
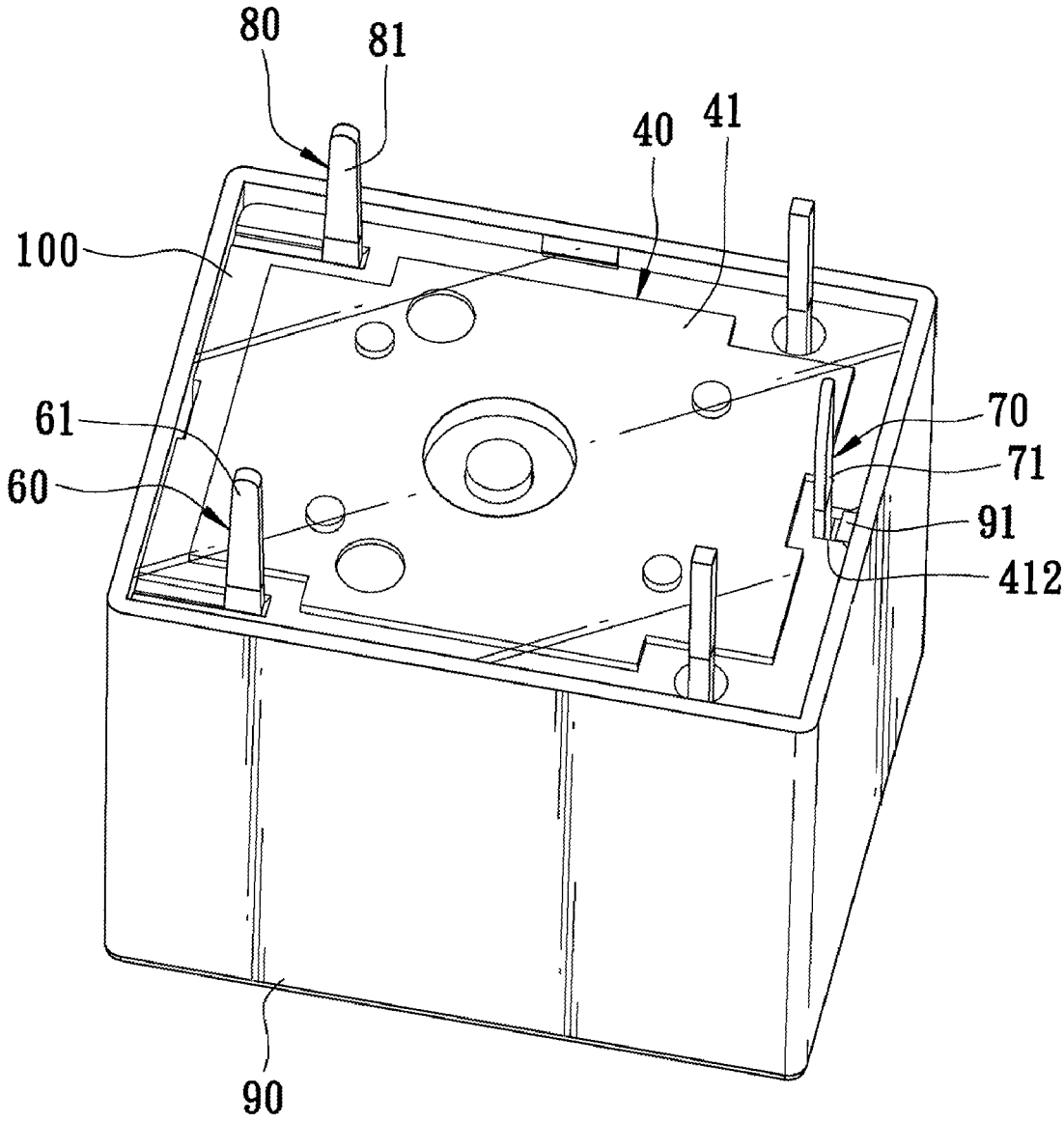
FIG. 18 is an assembled perspective view, illustrating the relay core member enclosed in a housing with sealant filled therebetween according to the preferred embodiment.
Figure 19:
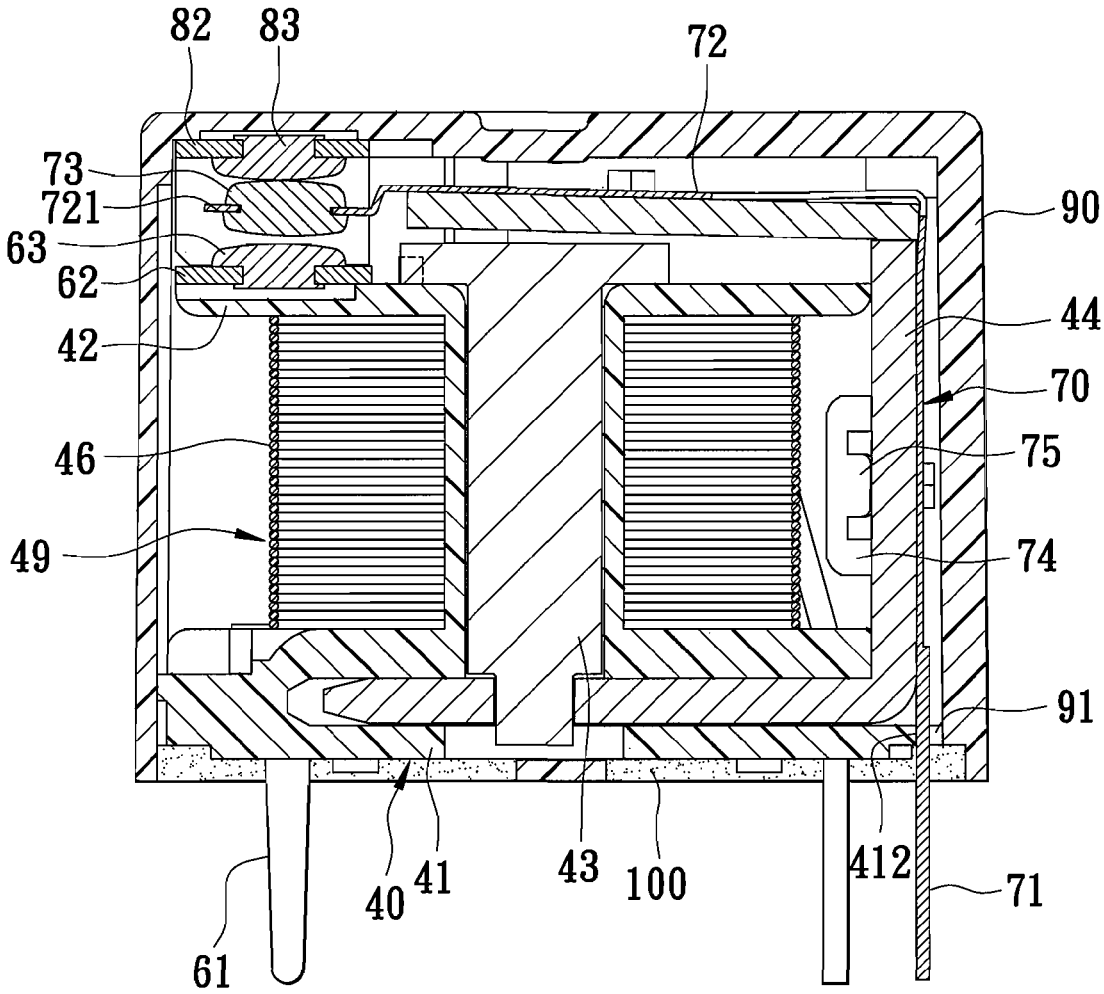
FIG. 19 is an assembled sectional view of the relay made according to the preferred embodiment when forming a first circuit.

As shown in FIGS. 10, 18, and 19, the step 35 is to enclose the relay core member 40, the first terminal 60, the second terminal 70, and the third terminal 80 within a housing 90, and to seal the housing 90 with resin 100 filled between the housing 90 and the base plate 41 of the relay core member 40. Preferably, the housing 90 includes a block 91 extending into the second notch 412 in the base plate 41 so as to prevent the resin 100 from flowing into the relay core member 40.

Figure 20:
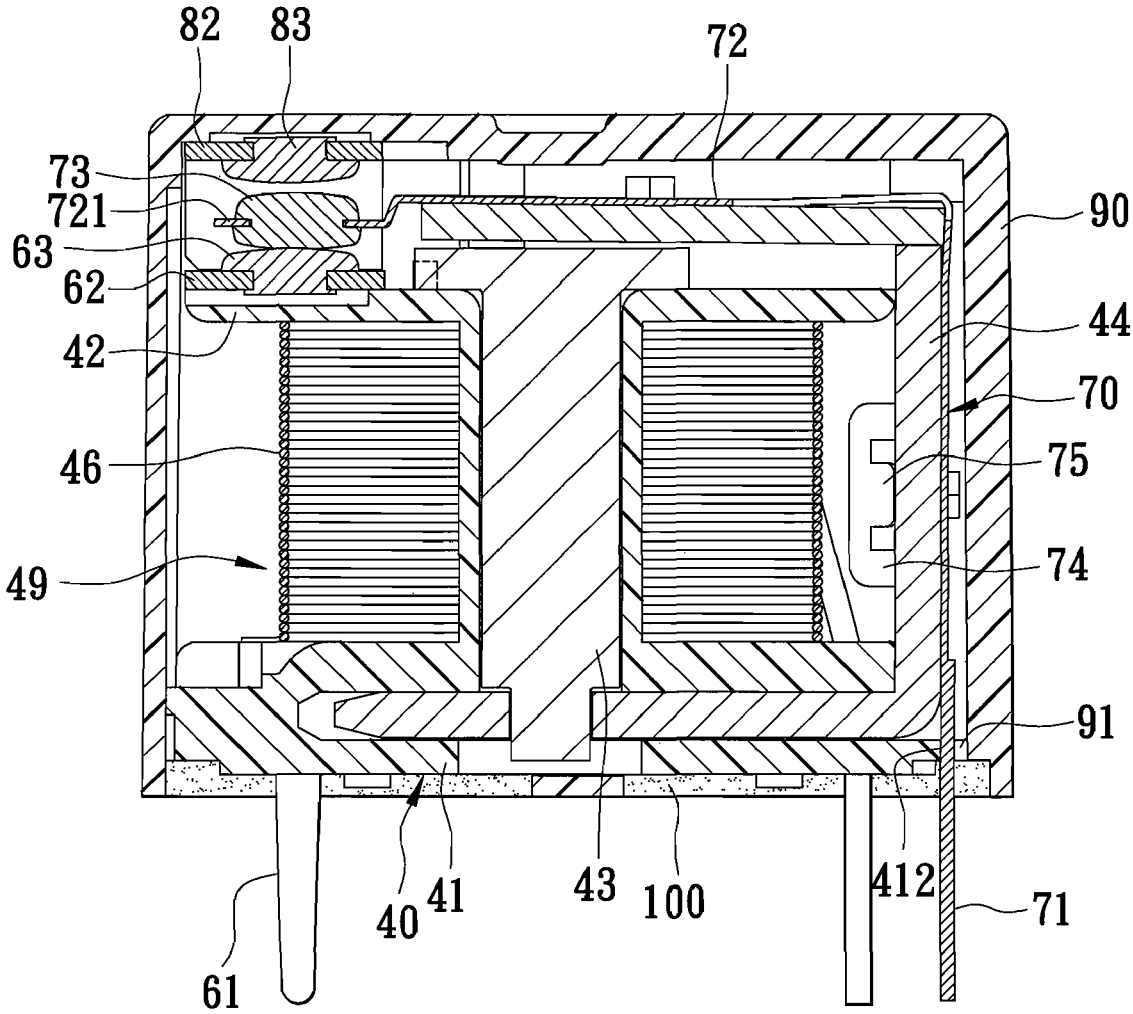
FIG. 20 is a view similar to FIG. 19, but illustrating the relay when forming a second circuit.

In use, the second contact 73 of the second terminal 70 contacts the third contact 83 of the third terminal 80 to form a first circuit (see FIG. 19) when current does not flow through the coil unit 49. When current flows through the coil unit 49, an electromagnetic field is generated to attract the resilient portion 72 of the second terminal 70 such that the second contact 73 is separated from the third contact 83 and contacts the first contact 63 of the first terminal 60, thereby forming a second circuit (see FIG. 20).

Since the second terminal 70 is coupled horizontally to the relay core member 40 with the second terminal portion 71 entering the second notch 412 in the base plate 41 via the opening 414, and since the tongue pieces 75 of the second terminal 70 engage simultaneously the connecting plate 44 when the second terminal portion 71 is inserted in the second notch 412, the step of coupling the second terminal 70 to the relay core member 40 can be automated as well as those of the first and third terminals 60, 80. Moreover, the aforementioned assembling process does not result in deviation of the resiliency of the resilient portion 72 of the second terminal 70. Compared to the prior art, the manual assembling and the manual adjustment of the second terminal can be eliminated in this invention, thereby resulting in a higher efficiency and a lower cost of manufacturing.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A method of making a relay comprising the steps of:

(A) preparing a relay core member that includes
- a base plate extending in a horizontal direction and formed with first, second, and third notches,
- a top plate extending in the horizontal direction and spaced apart from the base plate in a vertical direction,
- a coil unit extending in the vertical direction and disposed between the base and top plates, and
- a connecting plate interconnecting the base and top plates, and disposed between the second notch in the base plate and the coil unit;

(B) preparing a first terminal that has a first terminal portion, a first fixed portion extending perpendicularly from one edge of the first terminal portion, and a first contact disposed on the first fixed portion;

(C) coupling the first terminal to the relay core member by moving the first terminal horizontally relative to the relay core member such that the first terminal portion enters the first notch in the horizontal direction and extends downwardly through the base plate, and that the first fixed portion extends horizontally above the top plate of the relay core member;

(D) preparing a second terminal that has a second terminal portion, a resilient portion extending perpendicularly from one edge of the second terminal portion, a second contact disposed on the resilient portion, a pair of opposite wing portions formed at two sides of the second terminal portion, and a pair of tongue pieces formed respectively at the wing portions;

(E) folding the pair of opposite wing portions of the second terminal respectively at an angle relative to the second terminal;

(F) subsequent to folding the pair of opposite wing portions, coupling the second terminal to the relay core member by moving the second terminal exclusively in a horizontal direction relative to the relay core member such that the second terminal portion enters the second notch in the horizontal direction and extends downwardly through the base plate, that the resilient portion extends horizontally above the first fixed portion of the first terminal, that the second contact is registered with the first contact, and that the tongue pieces engage the connecting plate;

(G) preparing a third terminal that has a third terminal portion, a second fixed portion extending perpendicularly from one edge of the third terminal portion, and a third contact disposed on the second fixed portion;

(H) coupling the third terminal to the relay core member by moving the third terminal horizontally relative to the relay core member such that the third terminal portion enters the third notch in the horizontal direction and extends downwardly through the base plate, that the second fixed portion extends horizontally above the resilient portion of the second terminal and is supported thereat by the top plate of the relay core member, and that the third contact is registered with the second contact;

(I) enclosing the relay core member, the first terminal, the second terminal, and the third terminal within a housing; and (J) sealing the housing with resin filled between the housing and the base plate of the relay core member;

wherein the second contact of the second terminal is movable relative to the first contact and the third contact, and said first and second contacts are stationary with respect to the second contact.

* * * * *